US011674299B2

(12) United States Patent
Shan et al.

(10) Patent No.: US 11,674,299 B2
(45) Date of Patent: Jun. 13, 2023

(54) CROSS BEAM OF CANOPY

(71) Applicants: Caihua Shan, Taizhou (CN); Yucheng Shan, Taizhou (CN)

(72) Inventors: Caihua Shan, Taizhou (CN); Yucheng Shan, Taizhou (CN)

(73) Assignee: Zhejiang Shengge Technology Co., Ltd., Taizhou (CN)

( * ) Notice: Subject to any disclaimer, the term of this patent is extended or adjusted under 35 U.S.C. 154(b) by 0 days.

(21) Appl. No.: 17/567,165

(22) Filed: Jan. 3, 2022

(65) Prior Publication Data

US 2023/0080627 A1 Mar. 16, 2023

(30) Foreign Application Priority Data

Sep. 10, 2021 (CN) ..... 202111060920.9

(51) Int. Cl.
*E04B 1/24* (2006.01)
*E04B 1/58* (2006.01)
(Continued)

(52) U.S. Cl.
CPC ..... *E04B 1/2403* (2013.01); *E04B 1/58* (2013.01); *E04B 1/98* (2013.01); *E04B 1/5831* (2013.01);
(Continued)

(58) Field of Classification Search
CPC . E04B 1/2403; E04B 1/58; E04B 1/98; E04B 2001/2406; E04B 2001/2418;
(Continued)

(56) References Cited

U.S. PATENT DOCUMENTS 973,670 A * 10/1910 Kinnear ..... E02D 27/42 52/223.5
1,786,631 A * 12/1930 Roe ..... H02G 7/00 343/890
(Continued)

FOREIGN PATENT DOCUMENTS

CN 201265220 Y 7/2009
CN 202032743 U 11/2011
(Continued)

*Primary Examiner* — Brent W Herring
(74) *Attorney, Agent, or Firm* — Minder Law Group; Willy H. Wong

(57) ABSTRACT

The present invention provides a cross beam of a canopy, which addresses the problem that existing cross beams cannot simultaneously ensure convenience of assembly and guarantee stability in use. The present cross beam of a canopy comprises a plurality of hollow elongated beams, an inner side surface of each of the beams has at least one protruding and elongated protrusion along a length direction of the beams, each of the protrusions is provided with an mounting hole or a mounting groove penetrating along the length direction of the beams, at least one long rod is inserted into the mounting holes or the mounting grooves to connect all the beams in series, and two ends of the long rod protrude out of the beams and are detachably connected with a locking fastener respectively. The present invention ensures convenience of installation and guarantees the assembled cross beam has good stability.

7 Claims, 8 Drawing Sheets

(51) Int. Cl.
*E04B 1/98* (2006.01)
*E04C 3/04* (2006.01)

(52) U.S. Cl.
CPC ..... *E04B 2001/2406* (2013.01); *E04B 2001/2418* (2013.01); *E04B 2001/2448* (2013.01); *E04B 2001/2451* (2013.01); *E04B 2001/2457* (2013.01); *E04B 2001/5856* (2013.01); *E04C 2003/043* (2013.01)

(58) Field of Classification Search
CPC ..... E04B 2001/2448; E04B 2001/2451; E04B 2001/2856; E04B 2001/2457; E04B 1/5831; E04C 2003/043; E04C 2003/0439
USPC ..... 52/848, 849
See application file for complete search history.

(56) References Cited

U.S. PATENT DOCUMENTS 2,874,812 A * 2/1959 Clevett, Jr. ..... E04C 3/005 52/592.1
4,738,058 A * 4/1988 Svensson ..... F21V 21/10 52/843
5,092,087 A * 3/1992 Kane ..... E04D 3/06 52/200
5,218,801 A * 6/1993 Hereford ..... E04B 7/022 52/693
6,871,453 B2 * 3/2005 Locke ..... E04B 1/22 52/223.13
7,915,519 B2 * 3/2011 Kobayashi ..... F24S 25/61 52/173.3
9,154,074 B2 * 10/2015 West ..... F24S 25/20
9,243,817 B2 * 1/2016 West ..... F24S 25/16
2011/0070765 A1 * 3/2011 Kobayashi ..... F24S 25/65 439/387

FOREIGN PATENT DOCUMENTS

CN 203270807 U 11/2013
CN 203626375 U 6/2014
CN 204415231 U 6/2015
CN 106401271 A 2/2017
CN 106677392 A 5/2017
CN 206673509 U 11/2017
CN 206800624 U 12/2017
CN 207098826 U 3/2018
CN 207455069 U 6/2018
CN 208299582 U 12/2018
CN 208595346 U 3/2019
CN 208681416 U 4/2019
CN 109914601 A 6/2019
CN 208951469 U 6/2019
CN 208954580 U 6/2019
CN 209145110 U 7/2019
CN 210417336 U 4/2020
CN 210768832 U 6/2020
CN 211032591 U 7/2020
CN 212265655 U 1/2021
CN 213236373 U 5/2021

* cited by examiner

CROSS BEAM OF CANOPY

RELATED APPLICATIONS

This application claims benefit of China Patent Application No. CN202111060920.9, filed Sep. 10, 2021.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

TECHNICAL FIELD

The present invention pertains to the technical field of mechanics, and more particularly relates to a cross beam of a canopy.

BACKGROUND

A canopy is an architectural structure used to provide shade or shelter from weather conditions such as wind, rain and sun. Common forms of canopies are awnings, louver canopies, etc. A canopy generally comprises a vertical column, an elongated cross beam fixed to a top end of the column, and a covering mounted on the cross beam and used for shading, among which the covering may be louver, tarpaulin, etc. In actual manufacture and production, length and size of the cross beam will be adjusted according to market demands; however, if setting the length of the cross beam too long, it will reduce load-bearing capacity of the cross beam, and make an intermediate section of the cross beam prone to bending and deformation under load, thus lowering stability of fitting between the cross beam and the covering, and also affecting convenience of transportation.

In this regard, it is easy for a person skilled in the art to conceive of providing the cross beam as a split structure, such as the one shown in a spliceable canopy disclosed in Chinese Patent Application No. 200820163455, in which the canopy comprises a tarpaulin, a cross beam for supporting the tarpaulin and in an elongated shape, and a cross-beam liner in the shape of a rod, the cross beam is hollow and divided into two cross-beam segments both in an elongated shape, the two cross-beam segments are arranged all along their own linear direction and end faces of the two cross-beam segments are opposite to each other, one end of the cross-beam liner is inserted into one of the cross-beam segments and the other end of the cross-beam liner is inserted into the other cross-beam segment, and, the cross-beam liner and the cross-beam segments are connected by self-tapping screws; the split structure may also adopt the form of a telescopic structure constituted by the two cross-beam segments of the cross beam, i.e., one of the cross-beam segments is sleeved on the other cross-beam segment to achieve telescoping of the cross beam.

Due to the fact that, in actual use, two ends of the cross beam are connected to top ends of the columns, and the cross beam is load-bearing after installation of the covering, and connecting ends between the two cross-beam segments lack support, the cross-beam segments will tend to tilt downward around a joint between the cross beam and the column under load; excessive tilting will not only prevent the assembled cross-beam from being in a straight line, but also affect the fit between the cross-beam and the covering, even though the cross-beam liner is provided at a junction of the two cross-beam segments, and end portions of the two cross-beam segments in the telescopic structure always partially overlap in a stretched state, which to a certain extent can suppress the degree of tilting of the two cross-beam segments, the above-mentioned tilting problem still exists, making the cross-beam segments unable to maintain in a same straight line, causing the cross beam to be disabled for stable mounting of the covering and affecting stability of the cross beam in use. In addition, when using the split structure for assembly and connection, it is essential to align the cross-beam segments and install the cross-beam liners and the self-tapping screws at the junction of every two adjacent cross-beam segments during an assembly process, which requires multiple installations when using a multi-segment split structure, thus making assembly rather inconvenient.

SUMMARY

Some objectives of one embodiment of the present invention are to provide a cross beam of a canopy with respect to the above defects in the prior art, to solve one technical problem of how to guarantee stability of the cross beam in use while ensuring convenience of assembly.

The objectives of the present invention can be achieved by the following technical solution.

In one embodiment of a cross beam of a canopy, comprising a plurality of hollow elongated beams, wherein an inner side surface of each of the beams has at least one protruding and elongated protrusion along a length direction of the beams, each of the protrusions is provided with an mounting hole or a mounting groove penetrating along the length direction of the beams, at least one long rod is inserted into the mounting holes or the mounting grooves to connect all the beams in series, and two ends of the long rod protrude out of the beams and are detachably connected with a locking fastener respectively.

In this embodiment of the present invention, using one long rod to insert through all the beams makes it possible to quickly connect the individual beams in series to form a cross beam, and then installing the locking fastener at both ends of the long rod makes it possible to lock all the beams to the long rod, regardless of how many beams are connected in series to form the cross beam. Therefore, the cross beam assembly is more effortless, with a larger space to install the locking fasteners, and the assembled beams always have better stability by using the long rod and the locking fasteners.

Specifically, the long rod is inserted into the mounting holes or mounting grooves inside the individual beams in sequence to connect the individual beams in series, i.e. the long rod is inserted inside and through the individual beams, thus preventing the individual beams from being misaligned in a vertical direction. For example, if the cross beam comprises three or more beams, the weight of the intermediate-positioned beam(s) is applied to the long rod, and the long rod functions to keep the two end-positioned beams and the intermediate-positioned beam(s) always aligned in a straight line, ensuring that a covering can maintain its own stability after being installed on the cross beam. The long rod connects the individual beams in series and has the locking fasteners installed at the two ends of the long rod protruding from the beams, hence, by fastening the locking fasteners to the long rod, the locking fasteners at the two ends of each long rod can cooperate to limit the displacement of all the beams on the long rod, that is, setting positions of the locking fasteners is capable of positioning all the beams on the long rod. And in order to avoid collision between the individual beams, the locking fasteners may be fastened to abut against outer end surfaces of the two end-positioned beams to ensure stability of the cross beam in use.

Setting the protrusions on the inner side surfaces of the beams allows exterior of the cross beam to remain flat, thus facilitating installation of the covering and preventing coordination between the individual beams from being affected in event that the long rod is impacted by external forces. Providing the mounting holes or mounting grooves on the protrusions allows structural strength of the individual beams per se to be maintained, because of the following reasons: if providing the mounting holes or mounting grooves directly in the side walls of the beams, then in a state where the beams connected in series forming the cross beam are connected to the column, especially when the beams are in a load-bearing state after installation of the covering, intermediate regions of the side walls of the individual beams will be under high stress with increased stress concentration factors as a result of providing the mounting holes or mounting grooves directly in the side walls of the individual beams; in contrast, providing the protrusions so that the mounting holes or mounting grooves are distanced adequately from the side walls of the beams, eliminates the possibility of the side walls of the beams cracking under load, which would occur if the mounting holes or mounting grooves were provided directly in the side walls of the beams; besides, the protrusions also serve as reinforcement bars to ensure structural strength of the individual beams per se, thus ensuring stability of the entire cross beam in use.

In one embodiment of the above cross beam of the canopy, all the beams are butted with each other in sequence along the length direction of the beams, end faces of the two adjacent beams are disposed opposite to each other, the end faces of the two adjacent beams are abutted against each other tightly with the locking fastener. And end faces of two ends of each of the protrusions are flush with the end faces of two ends of the beams respectively.

In this embodiment, using a long rod to connect a number of beams in series and making end faces of the two adjacent beams abut against each other tightly under action of the locking fasteners, enables the adjacent beams to be mutually restrained, that is capable of not only making to mutually counteract tilt tendency of the adjacent beams, thereby inhibiting tilt of the beams, but also reducing the weight borne by the long rod, therefore, the individual beams are connected in a straight line, and the cross beam is kept balanced and stable. Making end faces of two ends of each of the protrusions flush with the end faces of two ends of the beams respectively, enables the protrusions on the two adjacent beams to abut against each other tightly under action of the locking fasteners, resulting in increased contact area of the two adjacent beams. In common cognition, the larger the contact area is, the less easy it is to make the end faces of each of the beams flat during machining, this would lead to poor stability of the beams after being assembled. But in this regard, because the mounting holes or mounting grooves are provided on the protrusions, so that the mounting holes or mounting grooves are set eccentrically with respect to the beams, and the eccentrically set mounting holes or mounting grooves make it possible to set the position of the long rod close to the side walls of the beams after the long rod is inserted through the mounting holes or mounting grooves, and because the locking fasteners clamp the beams at the two ends of the long rod, so that the portions of the beams located around the circumference of the long rod are subjected to greater clamping force by the locking fasteners. Hence, by setting the position of the long rod as described above enables the locking fasteners to clamp the beams at a position close to the side walls of the beams, ensuring that the end faces of the individual beams fit smoothly against each other, and because the long rod is located on the protrusions, the end faces of the individual protrusions can also fit against each other, mitigating the above-mentioned challenge that the end faces of the beams are not easily machined flat, thus maintaining stability of the beams after being assembled, making connection between the individual beams more stable, and keeping the entire cross beam stable in use.

In one embodiment of the above cross beam of the canopy, the locking fastener is a locking nut, the locking fastener is sleeved on the long rod and thread-connected with the long rod, and the locking fastener is capable of abutting against the end faces of the beams tightly.

In this embodiment, since the locking fastener is set to abut against the end faces of the beams tightly and both ends of the long rod are provided with the locking fastener, both ends of the long rod are subjected to an outward stretching force, i.e. the locking nut is tightened against the end faces of the beams, thereby straightening the long rod, keeping the long rod in a straight state and moderating bending deformation of the long rod. Thus, the locking fastener not only cooperates with the long rod to make the end faces of the individual beams abut against each other tightly, but also applies a force to the long rod to make the long rod taut, avoiding the long rod from oscillating in the mounting holes or mounting grooves, ensuring that the cross beam remains straight and stable in use. The above-described connection method using the locking nuts not only improves convenience in the process of assembling the cross beam, but also the locking nuts at the both ends of the long rods can push the two adjacent beams to move closer to each other until the end faces of the two adjacent beams abut against each other tightly, and in such an abutting manner, the gap between the end faces of the two adjacent beams can be fully eliminated, avoiding existence of gaps and achieving better adjustability.

The locking fastener also may be a circlip, and by providing a groove at a suitable location on the long rod, the circlip can snap-fit into the groove and achieve a snap connection to the beams.

In one embodiment of the above cross beam of the canopy, the locking fastener is capable of abutting against the end faces of the protrusions tightly.

In this embodiment, setting the locking nut to abut against the end faces of the protrusion, allows the position-constraining force exerted on the long rod by the locking nut to be transmitted in a centralized manner along the length of the protrusions, ensuring that the end faces of the two adjacent protrusions fit tightly against each other, thereby providing better bending-resistant limitation to the long rod, making the long rod stably connect the individual beams, limiting the degree of tilt of the beams, and thus ensuring the stability of the entire cross beam in use.

In one embodiment of the above cross beam of the canopy, the beams have a square tube shape, two opposite inner side surfaces of the beams are respectively provided with the protrusions, and the protrusions on the two opposite inner side surfaces are disposed symmetrically in pairs.

In this embodiment, setting the protrusions distributed on the two opposite inner side surfaces of the beams, allows the beams to be supported to a certain extent as well as kept in balance by the long rods provided inside and inserted through the protrusions; disposing the protrusions symmetrically in pairs, allows the weight of the beams to be evenly distributed among the long rods that are provided inside the protrusions by way of inserting through the mounting holes or mounting grooves on the protrusions, and thus allows the long rods to jointly resist bending deformation arising from concentrated forces on the long rods, thereby keeping the long rods in a straight state so as to ensure that the individual beams are arranged in a straight alignment and butted with each other in sequence; moreover, even if the long rods are bent and deformed by the weight, the symmetrically disposed protrusions make the bent and deformed positions on the long rods consistent and symmetrical, ensuring that the long rods always stably connect the individual beams, thus ensuring stability of the cross beam in use.

In one embodiment of the above cross beam of the canopy, a quantity of the protrusions is four, the four protrusions are distributed in pairs on the two opposite inner side surfaces of the beams, and the protrusions on each of the two opposite inner side surfaces are disposed symmetrically.

In this embodiment, such setting, in conjunction with the above-mentioned structure of symmetrical and pairwise setting of the protrusions on the two opposite inner surfaces, makes all the four protrusions symmetrically set in pairs. With the four protrusions being symmetrically set in pairs, the assembly of the beams is convenient, and at the same time the long rods are able to bear the weight evenly, thus improving stability of the cross beam in use. And with the four protrusions being symmetrically set in pairs, clamping force is evenly applied to various parts of the individual beams by the locking fasteners, so that the individual beams are evenly loaded and force balance is maintained.

In one embodiment of the above cross beam of the canopy, a watertight sealing member is provided between the end faces of the two adjacent beams, and the locking fastener is capable of pushing the two adjacent beams to move closer to each other to clamp the watertight sealing member tightly to form a seal between the two adjacent beams.

In this embodiment, the two ends of the long rod protrude respectively out of the outer ends of the two end-positioned beams, and the locking fastener pushes the beams from one end of the beams to move, and the watertight sealing member between the end faces of the two adjacent beams, thus, the pushing force exerted on the beams by the locking fastener and the force restraining the position of the beams by the locking fastener can be directly transferred to the watertight sealing member along the length of the long rod, so that the watertight sealing member can be fully squeezed by the beams on both sides to avoid displacement and achieve better watertight sealing effect, thereby ensuring stability of the cross beam in use.

In one embodiment of the above cross beam of the canopy, the watertight sealing member is waterproof glue. In this embodiment, where the watertight sealing member is waterproof glue, as the waterproof glue needs solidification in the process of use, and the above-mentioned structure that the two ends of the long rod protrude respectively out of the outer ends of the two end-positioned beams can ensure coaxiality between the two adjacent beams and thus ensure stable fitting between the end faces of the two adjacent beams, so it facilitates solidification of the waterproof glue to achieve waterproofing.

The watertight sealing member also may be a sealing ring.

Compared to the prior art, the cross beam of the canopy in accordance with the present invention has the following advantages:

1. Providing one or more long rods inside and inserted through the beams, allows the long rods to be hidden and outer side surfaces of the beams to be flat. Moreover, using the long rod to insert through all beams and then installing locking fasteners at both ends of the long rod, makes installation according to the present application more convenient, compared to using connecting members between every two adjacent beams for connection of the beams.

2. Setting the long rod to insert through the individual beams arranged in the same linear direction in sequence and the both ends of the long rod to protrude out of the beams respectively, not only facilitates installation of the locking fastener, but also makes the individual beams connected in a straight line, avoiding misalignment between end faces of the two adjacent beams and ensuring stability of fitting between the cross beam and the covering.

3. The locking fastener on the long rod can both push the end faces of the two adjacent beams to abut against each other and facilitate waterproofing between two adjacent beams, and also can exert an outward stretching force on the long rod to keep the long rod in a straight state, thus making the individual beams connected in a straight and stable manner and avoiding tilting of the individual beams.

4. Owing to the eccentric setting of the mounting holes or mounting grooves on the protrusions of the beams, in conjunction with the setting of end faces of two ends of each of the protrusions to be flush with the end faces of two ends of the beams respectively, although the protrusions increase contact area between the two adjacent beams while bringing about the challenge that the end faces of the individual beams are not easily machined flat, the eccentric setting of the mounting holes or mounting grooves makes it possible to set the position of the long rod close to the side walls of the beams after the long rod is inserted through the mounting holes or mounting grooves, allowing the end faces of the two adjacent beams to abut against each other adequately, thus ensuring stability of the cross beam.

DETAILED DESCRIPTION

Set forth below are specific embodiments of the present invention and a further description of the technical solutions of the present invention in conjunction with the accompanying drawings, but the present invention is not limited to these embodiments.

First Embodiment

Figure 1:
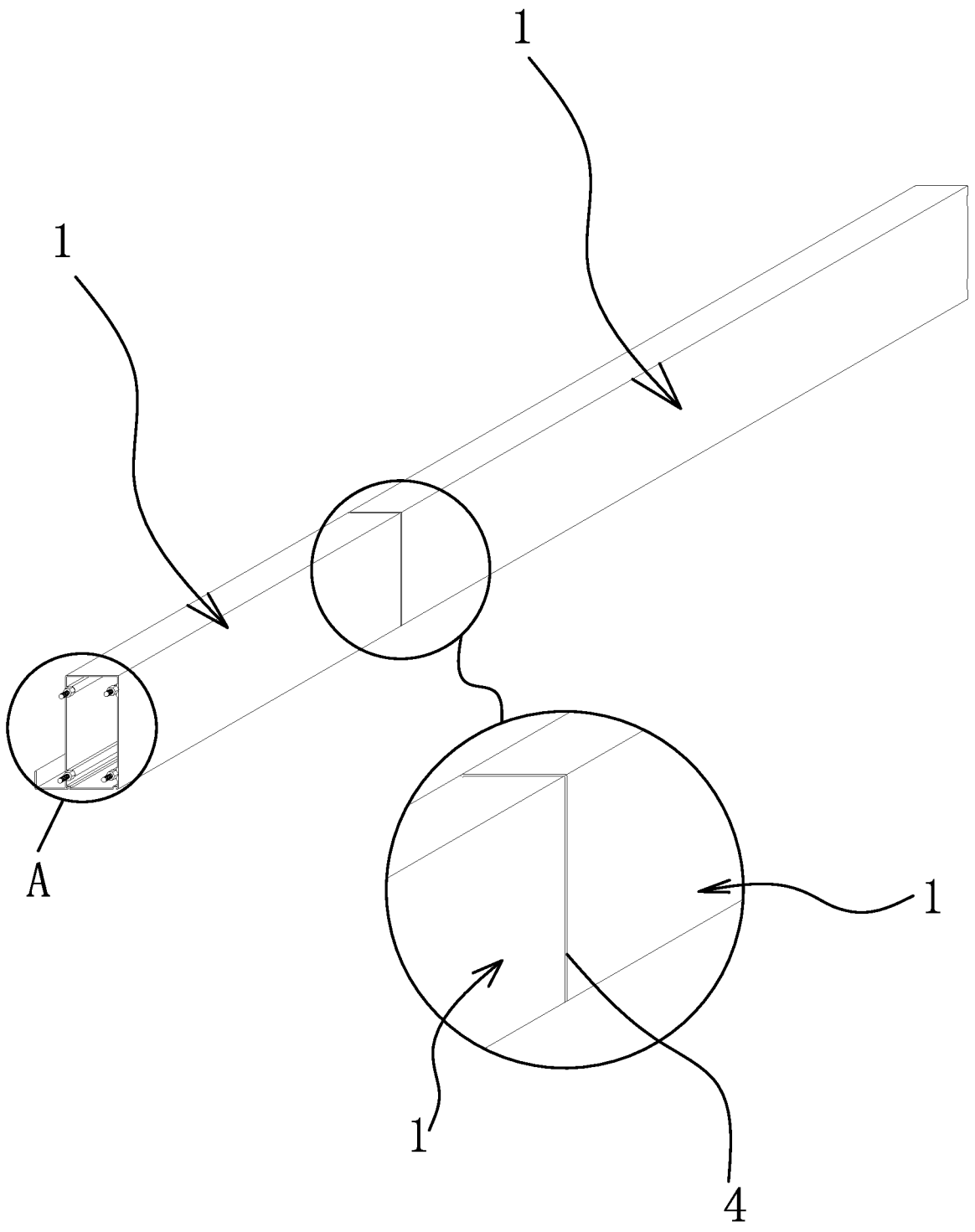
FIG. 1 is a perspective view of a structure of a first embodiment of the present invention.
Figure 3:
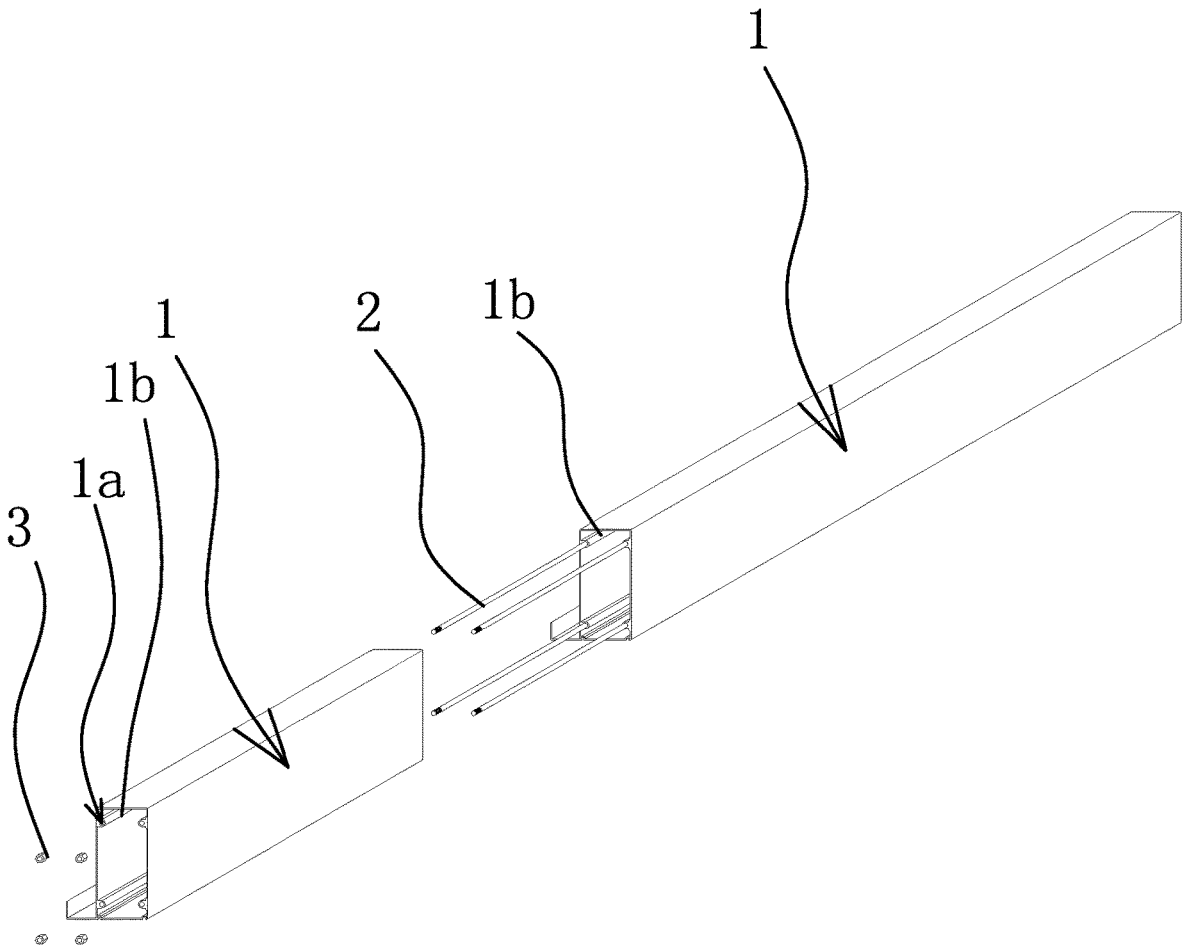
FIG. 3 is an exploded perspective view of the first embodiment.

As shown in FIGS. 1 and 3, one embodiment of a cross beam of a canopy according to the present invention comprises: two beams 1 both having an elongated square tube shape, and four long rods 2. The two beams 1 are arranged along a straight line, and two end faces of the two beams 1 are set opposite to each other. Two vertically opposite inner side surfaces of each of the beams 1 are respectively provided with two protruding protrusions 1*b* which are arranged in a vertical direction, with the positions of the two protrusions 1*b* on the opposite inner side surfaces being set opposite to each other. Each of the protrusions 1*b* is elongated, and end faces of the two ends of each of the protrusions 1*b* are flush with end faces of the two ends of the beam 1. Each of the protrusions 1*b* is provided with a mounting hole 1*a* along the length direction penetrating through the two end faces of the two ends of the protrusion 1*b*, with each of the mounting holes 1*a* being set eccentrically relative to the beam 1. The two beams 1 are aligned and butted along the length direction, such that the mounting holes 1*a* on the respective beams 1 are butted in sequence and fluidly communicate to form a straight elongated locking passage. Each of the long rods 2 is inserted through the locking passage to connect the two beams 1 in series, and each of the long rods 2 is set close to the side walls of the beams 1. The two ends of each of the long rods 2 protrude respectively out of the two ends of the locking passage, i.e., the two ends of the long rod 2 protrude respectively out of the end faces of the outer ends of the two beams 1, and at the same time the both ends of the long rod 2 are detachably connected with a locking fastener 3 that can make the end faces of the two beams 1 to abut against each other and to be positioned. After the two beams are connected in series by the long rods 2 to form a cross beam, the outer ends of the two beams 1 become two ends of the cross beam, and the two ends of the cross beam are fixedly connected to a column 5 respectively. The long rods 2 provided in the mounting holes 1*a* of the beams 1, in addition to connecting the individual beams 1, also share the gravity of the beams 1, thus improving structural strength of the beams 1. When the beams 1 per se without the long rod 2 would be deformed due to excessive load-bearing after installation of a covering, installing the long rods 2 on the beams 1 is capable of improving structural strength of the beams 1, making the individual beams 1 maintain the flat attitude, thus the long rods 2 are capable of avoiding deformation of the beams 1 per se.

Figure 7:
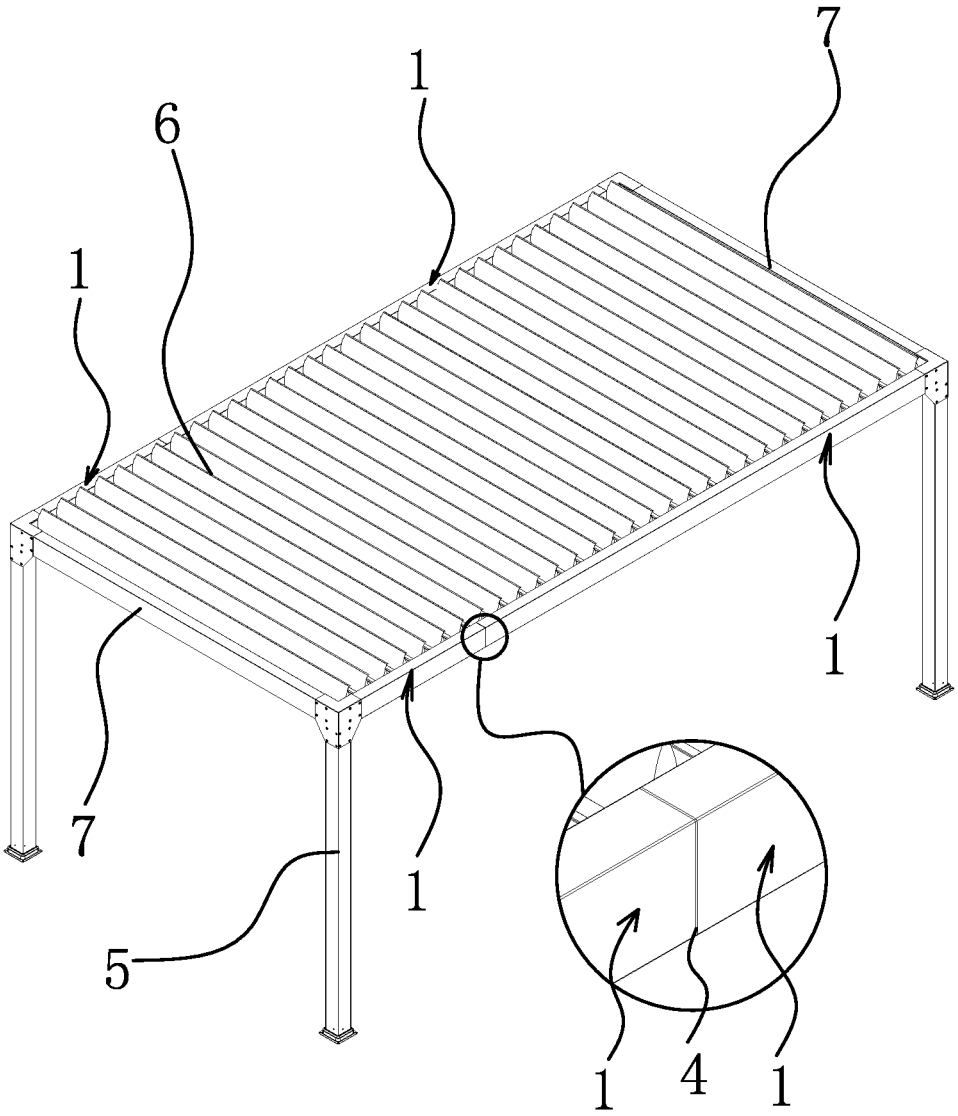
FIG. 7 is a perspective view of a structure of a canopy installed with the cross beam in accordance with the first embodiment.

As shown in FIG. 7, the two ends of the cross beam are connected to the column 5 respectively, i.e., one end of the beams 1 at the two end positions is supported by the column 5 while the other end abuts against the adjacent beam 1. Based on a state of the present cross beam of the canopy after the cross beam is assembled with the column 5, the side of the cross beam connected to the column 5 is referred to as a lower side, and the side of the cross beam away from the column 5 is referred to as an upper side. As shown in FIGS. 1 and 3, two opposite protrusions 1*b* on the inner side surfaces of the beam 1 are provided close to the lower side of the beam 1, and the long rods 2 after being inserted into the mounting holes 1*a* on those protrusions 1*b* are connected to locking fasteners 3, and those two long rods 2 inserted through the mounting holes 1*a* are located close to the column 5 in the vertical direction; when the inner ends of the two beams 1 tilts downward due to load-bearing, upper sides of the two abutting end faces of the two adjacent beams 1 will abut against each other tightly, while lower sides of the two abutting end faces of the two adjacent beams 1 will have a tendency to expand outward; at this point, the long rods 2 inserted through the protrusions 1*b* and the locking fasteners 3 at both ends of the long rods 2 can clamp the lower sides of the two beams 1 sufficiently tightly, inhibiting the outward expanding tendency of the lower sides of the abutting end faces of the two adjacent beams 1, limiting the degree of tilting of the beams 1, reducing the force that drives the long rods 2 to bend due to the tilting of the beams 1, and thus ensuring a straight and stable connection between the individual beams 1. Moreover, when the lower sides of the abutting end faces of the two adjacent beams 1 have the above-mentioned outward expanding tendency, the outer ends of the two adjacent beams 1 exert an outward pushing force on the locking fasteners 3, thereby the locking fasteners 3 can take advantage of this force to straighten the long rods 2, so as to alleviate the bending force on the long rods 2 due to load bearing of the long rods 2, thus ensuring that the two adjacent beams 1 are connected in a straight state.

As shown in FIG. 3, one embodiment of the mounting holes 1*a* are round holes, and the long rods 2 are round rods; assembly clearance between hole walls of the mounting holes 1*a* and outer circumferential surfaces of the long rods 2 makes the hole walls of the mounting holes 1*a* have a limiting effect on the long rods 2. In conventional assembly, the assembly clearance facilitates installation of the long rods 2, while in practice the assembly clearance may not be set too large, i.e., outer diameters of the long rods 2 may be slightly smaller than hole diameters of the mounting holes 1*a*, and in this way, when the long rod 2 tends to bend under load, the hole walls of the mounting holes 1*a* can limit the bending extent of the long rod 2, or even if the long rod 2 bends, the outer circumferential surface of the long rod 2 will directly abut against the hole walls of the mounting holes 1*a* to makes the long rod 2 cannot continue to bend, that is capable of keeping the long rod 2 straight, and thus limiting the degree of tilt of the beams 1. Keeping the long rod 2 straight at all times can counteract bending tendency of the individual beams 1 due to weight and load, making the individual beams 1 arranged in a straight state and connected stably, thus improving stability of the entire cross beam in use.

Figure 4:
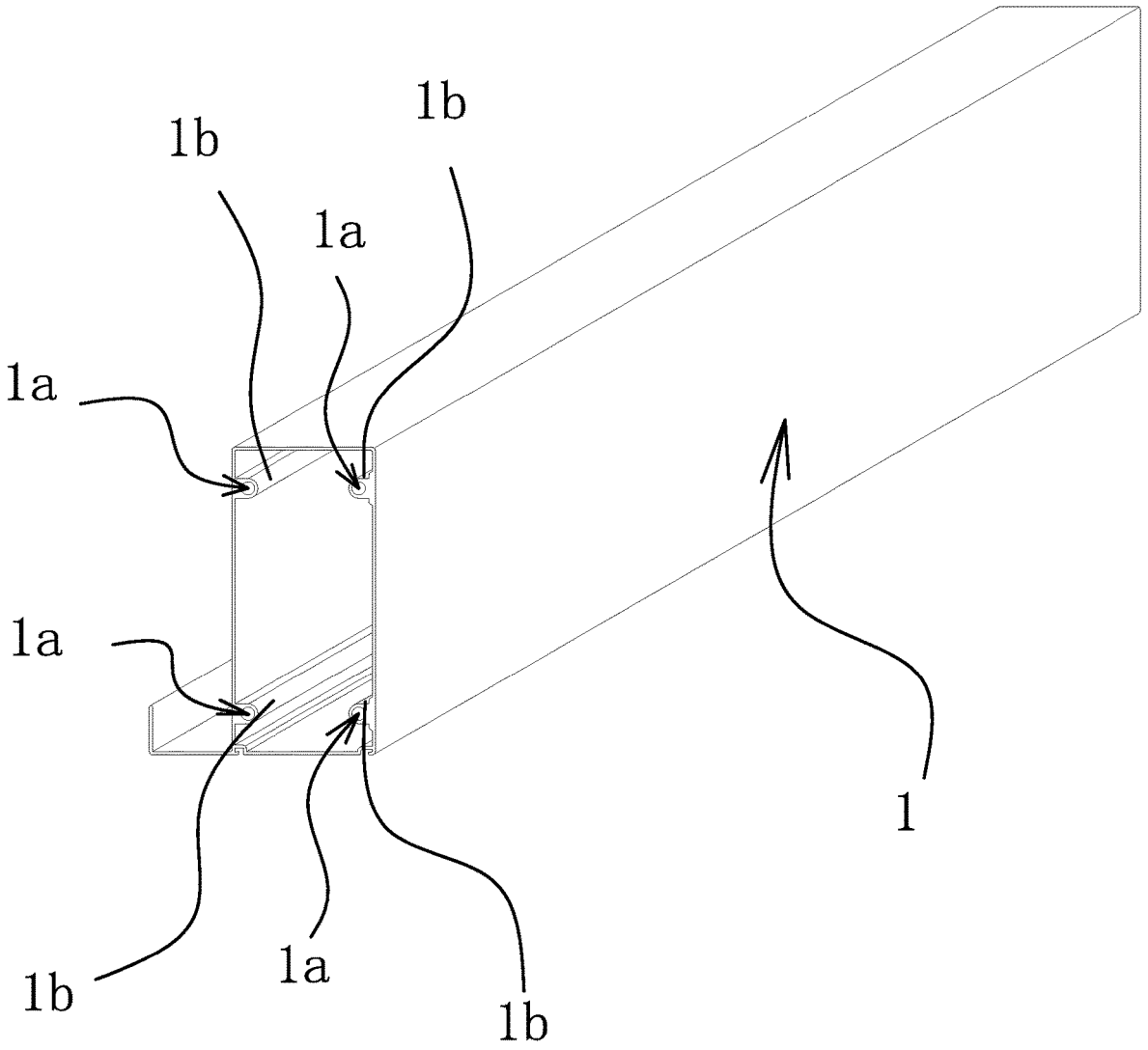
FIG. 4 is a perspective view of a structure of the beam in the first embodiment.
Figure 5:
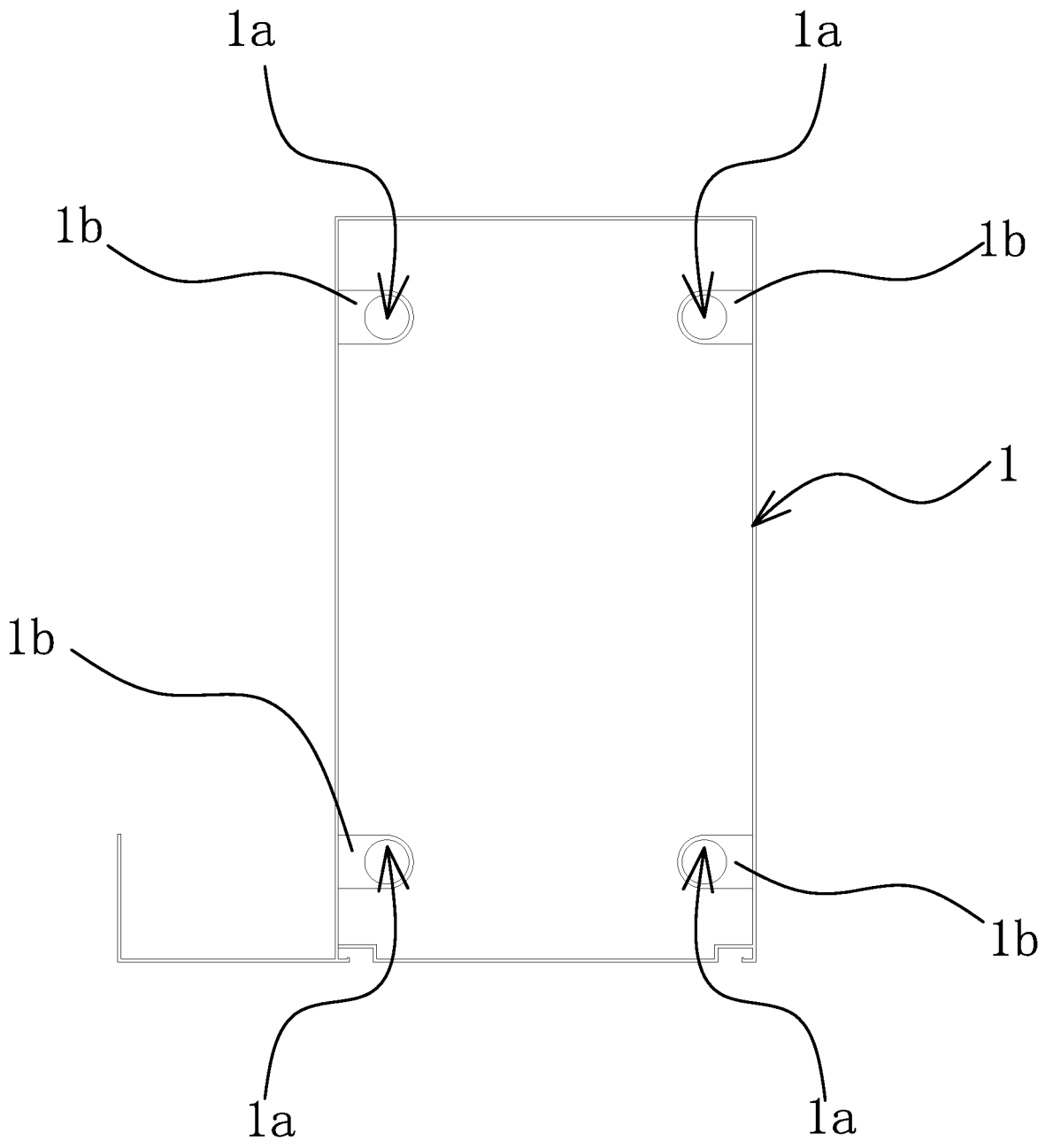
FIG. 5 is a side view of the beam in the first embodiment.
Figure 6:
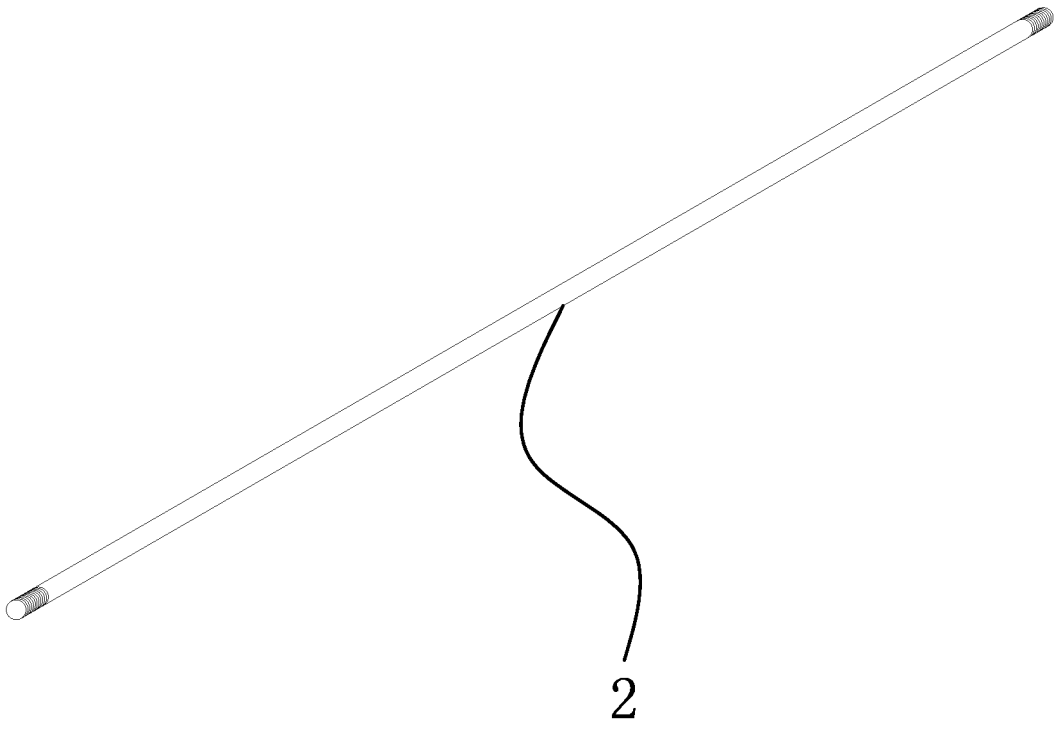
FIG. 6 is a perspective view of a structure of a long rod in the first embodiment.

As shown in FIGS. 4 and 5, one embodiment of the two protrusions 1*b* provided on the same inner side surface of the beam 1 are arranged in a straight line along the vertical direction, and are disposed symmetrically with respect to a horizontal centerline of that inner side surface. After the cross beam is installed on the columns 5, the protrusions 1*b* provided on the two vertically opposite inner side surfaces within the cross beam are positioned symmetrically with respect to each other, and are capable of sharing the gravitational force within the cross beam and serving to support the individual beams 1.

Figure 2:
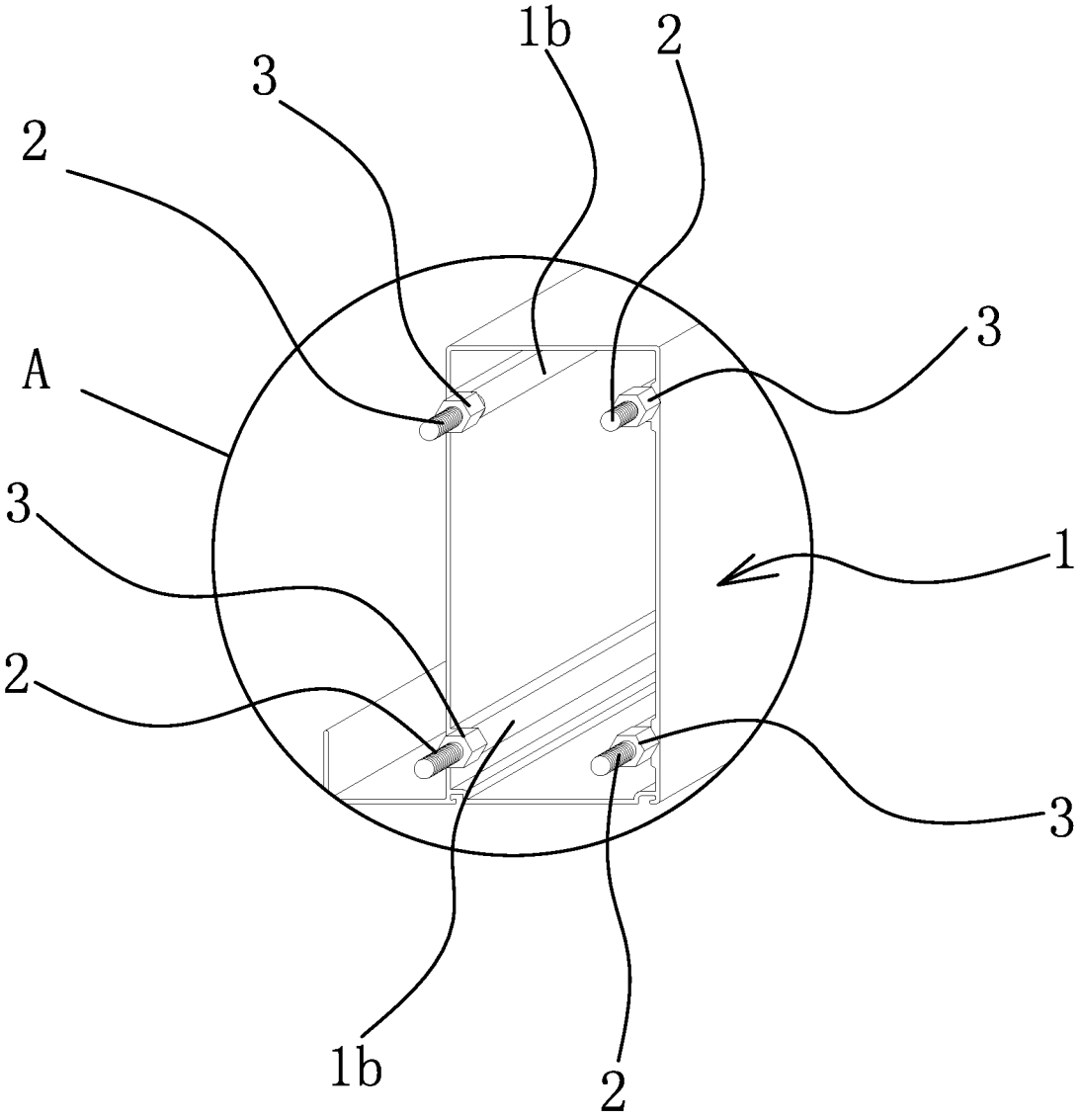
FIG. 2 is an enlarged perspective view of the structure at a location "A" in FIG. 1.

As shown in FIG. 2, one embodiment of the locking fastener 3 is a locking nut, and the locking fastener 3 is sleeved on the long rod 2 and thread-connected with the end of the long rod 2. When the long rod 2 is inserted through the mounting holes 1*a* on the two beams 1, the locking fastener 3 can move on the long rod 2 and push the two beams 1 to move toward each other so that the end faces of the two beams 1 abut against each other tightly; after the end faces of the two beams 1 abut against each other tightly, the locking nut abut against the end face of the protrusion 1*b*, thereby the locking fasteners 3 at the two ends of the long rod 2 can straighten the long rod 2, thus ensuring stability of the long rod 2.

As shown in FIGS. 1 and 7, one embodiment of a watertight sealing member 4 is provided between the end faces of the two adjacent beams 1; when the two adjacent beams 1 move closer to each other under action of the locking fasteners 3, the two adjacent beams 1 can clamp the watertight sealing member 4 tightly to form a seal between the two adjacent beams 1. In this embodiment, the watertight sealing member 4 is waterproof glue, which is compression-resistant, drop-proof, frozen-resistant and has strong sealing capability; the waterproof glue solidifies under squeezing of the beams 1, ensuring reliability of the waterproof glue.

In one embodiment, the long rod 2 is a thin rod, which is relatively lightweight and easy to transport, but the thin rod has the challenge of poor load-bearing performance; the structure provided by the present application makes it possible to maintain a stable fitting between the individual beams even using a thin rod for connection, ensuring stability between the individual beams while improving convenience of transportation, therefore, the present application is of good practicality.

In one embodiment, the protruding degree of the protrusions 1*b* should be adapted to outer diameter of the long rod 2, i.e., slightly larger than the outer diameter of the long rod 2, otherwise, too large protruding degree will impair structural strength of the protrusions 1*b*. As shown in FIG. 7, the canopy in this embodiment is a louver canopy, and the canopy comprises vertically disposed columns 5 and a top frame fixed to top ends of the columns 5 and in a quadrilateral shape. The top frame may be constituted entirely by the cross beams provided in this embodiment or by the cross beams provided in this embodiment and one-piece short beams 7, depending on actual requirements for dimensions. In this embodiment, the top frame of the canopy is in a rectangular shape and is formed by combination and assembly of two oppositely disposed cross beams and two oppositely disposed short beams 7, among which a number of louvers 6 are rotatably connected to the two oppositely disposed cross beams.

Both vertical and horizontal directions in this embodiment are based on the state of the cross beam after it is installed on the column 5 and assembled into the canopy.

Second Embodiment

Figure 8:
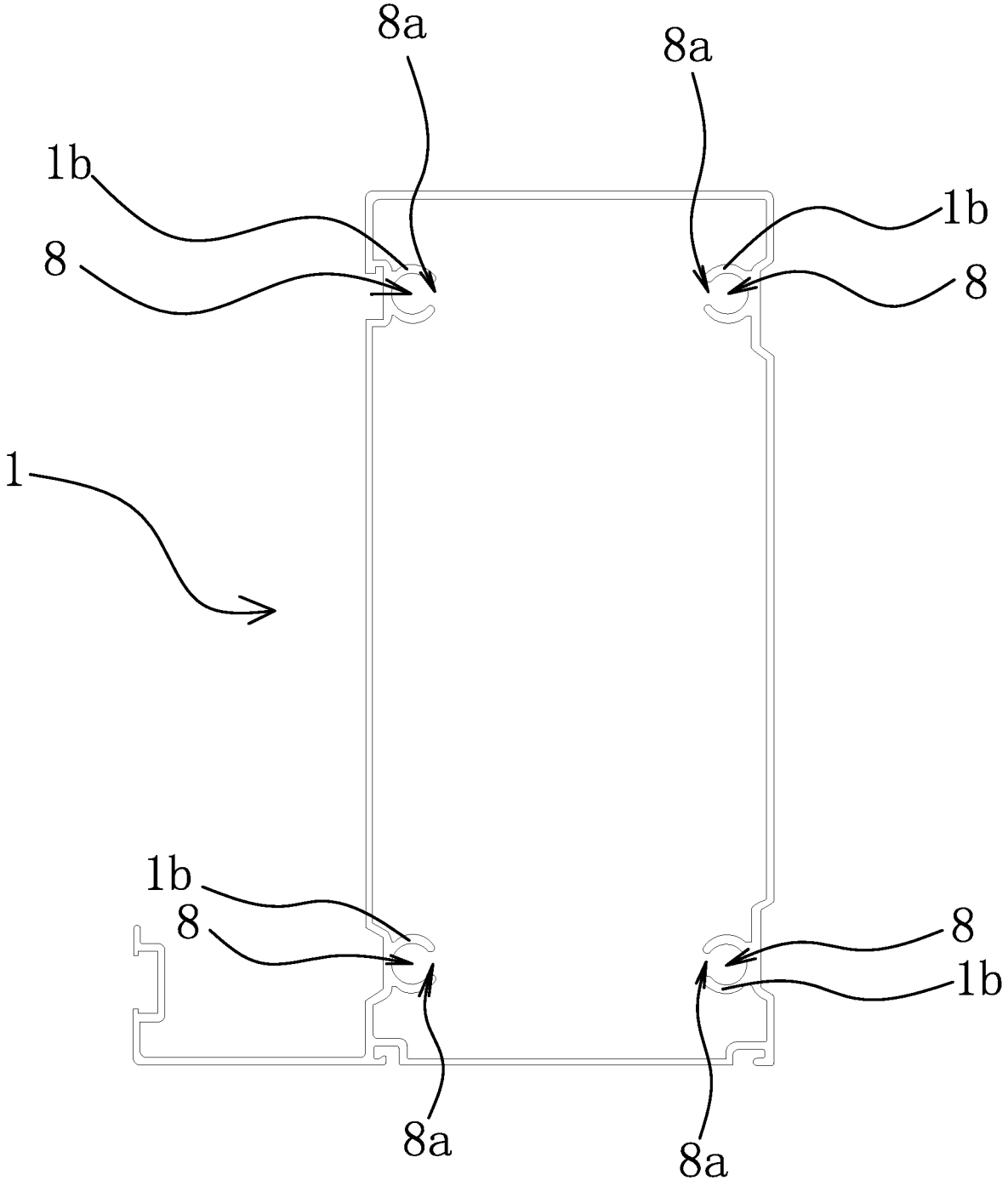
FIG. 8 is a side view of a beam in a second embodiment of the present invention.

As shown in FIG. 8, this embodiment has substantially the same structure and principle as the first embodiment, with the following differences: each protrusion 1*b* on each of the beams 1 is provided with an elongated mounting groove 8 which penetrates through the protrusion 1*b* in the length direction and has a groove opening 8*a*. The long rod 2 is inserted through the mounting groove 8 along the length direction of the mounting groove 8, with each end of the long rod 2 protruding out of the mounting groove 8. Such adopted form of the mounting groove 8 reduces the area of the long rod 2 contacting with the inner side wall of the mounting groove 8 when passing through the mounting groove 8, thereby facilitating the long rod 2 smoothly passing through the mounting groove 8; in the meantime, the groove opening 8*a* of the mounting groove 8 has a convergent shape such that each of the protrusions 1*b* has a C-shaped vertical cross-section, hence the groove opening 8*a* of the mounting groove 8 reduces area of the end face of the protrusion 1*b*, allowing improving flatness of both the end face of the protrusion 1*b* and the end face of the beam 1 during machining, and further allowing improving fitting of the abutting end faces of the two adjacent beams 1 as being clamped tightly under action of the locking fasteners 3, thus improving stability of fitting between the individual beams 1; the groove openings 8*a* of the mounting grooves 8 on the two opposite protrusions 1*b* that are disposed symmetrically and provided on the two inner vertically opposite side surfaces of each of the beams 1 respectively, are set opposite to each other, so that internal air of the mounting grooves 8 and internal air of the beams 1 circulate with each other; if the cross beam is used in rainy environment for a long time, humid air or water droplets will easily enter the mounting groove 8 from both ends of the mounting groove 8, the designed form of the groove opening 8*a* of the mounting groove 8 can accelerate evaporation of moisture and air circulation in the mounting groove 8 to avoid the long rod 2 from rusting due to long-term contact with the humid air or water droplets, thus ensuring solidity and stability of the cross beam of the present application.

Descriptions related to orientation in this embodiment is based on a state of the cross beam after it is installed on the column.

Although terms such as beam, locking fastener, etc. are used herein, the possibility of using other technical terms is not excluded. These technical terms are merely used to describe and explain the nature of the invention more conveniently; construing them as any additional limitation is contrary to the scope of the invention.

LIST OF REFERENCED PARTS

1 Beam
1*a* Mounting Hole
1*b* Protrusion
2 Long Rod
3 Locking Fastener
4 Watertight Sealing Member
5 Column
6 Louver
7 Short Beam
8 Mounting Groove
8*a* Groove Opening

The invention claimed is:

1. A cross beam of a canopy comprising a plurality of hollow elongated beams, wherein an inner side surface of each of the beams has at least one protruding and elongated protrusion along a length direction of the beams, each of the protrusions is provided with a mounting hole or a mounting groove penetrating along the length direction of the beams, at least one long rod is inserted into the mounting holes or the mounting grooves to connect all the beams in series, and two ends of the long rod protrude out of the beams and are detachably connected with a locking fastener respectively; and wherein all the beams are butted with each other in sequence along the length direction of the beams, end faces of the two adjacent beams are disposed opposite to each other, the end faces of the two adjacent beams are abutted against each other tightly with the locking fastener, and end faces of two ends of each of the protrusions are flush with the end faces of two ends of the beams respectively.

2. The cross beam of the canopy as claimed in claim 1, wherein the locking fastener is a locking nut, the locking fastener is sleeved on the long rod and thread-connected with the long rod, and the locking fastener is capable of abutting against the end faces of the beams tightly.

3. The cross beam of the canopy as claimed in claim 2, wherein the locking fastener is capable of abutting against the end faces of the protrusions tightly.

4. The cross beam of the canopy as claimed in claim 1, wherein the beams have a square tube shape, two opposite inner side surfaces of the beams are respectively provided with the protrusions, and the protrusions on the two opposite inner side surfaces are disposed symmetrically in pairs.

5. The cross beam of the canopy as claimed in claim 4, wherein a quantity of the protrusions is four, the four protrusions are distributed in pairs on the two opposite inner side surfaces of the beams, and the protrusions on each of the two opposite inner side surfaces are disposed symmetrically.

6. The cross beam of the canopy as claimed in claim 1, wherein a watertight sealing member is provided between the end faces of the two adjacent beams, and the locking fastener is capable of pushing the two adjacent beams to move closer to each other to clamp the watertight sealing member tightly to form a seal between the two adjacent beams.

7. The cross beam of the canopy as claimed in claim 6, wherein the watertight sealing member is waterproof glue.

* * * * *